US006666159B2

(12) United States Patent
Larson et al.

(10) Patent No.: US 6,666,159 B2
(45) Date of Patent: Dec. 23, 2003

(54) WATER SPORT TOWING APPARATUS

(75) Inventors: Borden M. Larson, Orlando, FL (US); William N. Snook, Orlando, FL (US)

(73) Assignee: Correct Craft, Inc., Orlando, FL (US)

( * ) Notice: Subject to any disclaimer, the term of this patent is extended or adjusted under 35 U.S.C. 154(b) by 0 days.

(21) Appl. No.: 10/095,387

(22) Filed: Mar. 12, 2002

(65) Prior Publication Data

US 2002/0134293 A1 Sep. 26, 2002

Related U.S. Application Data

(63) Continuation of application No. 09/624,166, filed on Jul. 24, 2000, now Pat. No. 6,374,762, which is a continuation-in-part of application No. 09/399,683, filed on Sep. 21, 1999, now Pat. No. 6,192,819, which is a continuation-in-part of application No. 09/036,862, filed on Mar. 9, 1988, now Pat. No. 5,979,350, which is a continuation-in-part of application No. 29/078,494, filed on Oct. 27, 1997, now Pat. No. Des. 409,972.

(51) Int. Cl.[7] ..... B63B 21/04
(52) U.S. Cl. ..... 114/253; 114/242
(58) Field of Search ..... 114/253, 125, 114/242, 254, 255, 361

(56) References Cited

U.S. PATENT DOCUMENTS

| | | | | |
|---|---|---|---|---|
| 2,821,726 A | * | 2/1958 | Correll | 104/53 |
| 3,034,470 A | * | 5/1962 | Vanderfeltz et al. | 114/218 |
| D195,068 S | | 4/1963 | Griparis | |
| 3,110,331 A | * | 11/1963 | Buchanan | 114/217 |
| 3,122,609 A | | 2/1964 | Moore | |
| 3,326,175 A | * | 6/1967 | Baker | 114/254 |
| 3,336,894 A | | 8/1967 | Eisner | |
| 3,503,358 A | | 3/1970 | Moesly | |
| 3,724,595 A | | 4/1973 | Green | |
| 3,811,143 A | | 5/1974 | Page | |
| 3,890,918 A | * | 6/1975 | Sell | 114/253 |
| 3,925,836 A | | 12/1975 | Simmonds | |
| 3,935,830 A | | 2/1976 | Cox | |
| 3,949,698 A | | 4/1976 | Sell | |
| 4,033,280 A | | 7/1977 | Wood et al. | |
| 4,163,529 A | | 8/1979 | Krenzer et al. | |
| 4,528,927 A | | 7/1985 | Iizuka et al. | |
| 4,561,375 A | | 12/1985 | Paxton | |
| 4,593,641 A | | 6/1986 | Adams et al. | |
| 4,641,597 A | | 2/1987 | Paxton | |
| 4,694,773 A | | 9/1987 | Sparkes et al. | |
| 4,893,577 A | | 1/1990 | Jennings | |
| 5,018,474 A | | 5/1991 | Jellen | |
| 5,052,326 A | | 10/1991 | Wiggen et al. | |
| 5,105,754 A | | 4/1992 | Collins | |

(List continued on next page.)

FOREIGN PATENT DOCUMENTS

| | | | | |
|---|---|---|---|---|
| DE | 4007645 A1 | * | 9/1991 | B63B/21/04 |
| JP | 2001-294195 A | * | 10/2001 | 114/255 |

OTHER PUBLICATIONS

Alan Jones, A Star is Born, Boating World, Sep. 1977, pp. 33–34.

Seabrite Stainless Steel Marine Products, single page copy of brochure.

Photocopy of Police Resource Boat Photo.

*Primary Examiner*—S. Joseph Morano
*Assistant Examiner*—Ajay Vasudeva
(74) *Attorney, Agent, or Firm*—Allen, Dyer, Doppelt, Milbrath & Gilchrist, P.A.

(57) ABSTRACT

A method for improving the performance of a wakeboard performer being towed by a vessel having a bow, stern, opposing gunnels and an operator station comprises fitting a skeletal towing frame to the vessel with first, second and third spaced supports attached on opposite sides of the vessel and coupling the upper extremities thereof together with a horizontal bridging portion, to which is fitted a tow rope attachment point.

11 Claims, 9 Drawing Sheets

U.S. PATENT DOCUMENTS

| | | | | | |
|---|---|---|---|---|---|
| 5,215,025 | A | | 6/1993 | Talmor | |
| 5,520,139 | A | | 5/1996 | King et al. | |
| 5,645,003 | A | | 7/1997 | Grinde | |
| 5,669,325 | A | | 9/1997 | Feikema | |
| 5,673,507 | A | | 10/1997 | Stokes, Jr. | |
| D395,866 | S | | 7/1998 | Fowler et al. | |
| 5,934,217 | A | | 8/1999 | Allsop | |
| 5,943,977 | A | | 8/1999 | Womack et al. | |
| 5,979,350 | A | * | 11/1999 | Larson et al. | 114/253 |
| 6,044,788 | A | * | 4/2000 | Larson et al. | 114/125 |
| 6,192,819 | B1 | * | 2/2001 | Larson et al. | 114/253 |
| 6,374,762 | B1 | * | 4/2002 | Larson et al. | 114/253 |
| 6,427,616 | B1 | * | 8/2002 | Hagen | 114/121 |
| RE37,823 | E | * | 9/2002 | Larson et al. | 114/253 |
| 6,453,839 | B2 | * | 9/2002 | Roeseler et al. | 114/102.16 |
| 2001/0006037 | A1 | * | 1/2001 | Badley | 114/253 |

* cited by examiner

WATER SPORT TOWING APPARATUS

CROSS REFERENCE TO RELATED APPLICATIONS

This application is a continuation of and hereby incorporates by reference the disclosure of application Ser. No. 09/624,166. filed Jul. 24, 2000, issuing as U.S. Pat. No. 6,374,762 which itself is a continuation-in-part of application Ser. No. 09/399,683 filed Sep. 21, 1999, now U.S. Pat. No. 6,192,819, for "Water Sport Towing Apparatus," which itself is a continuation-in-part of application Ser. No. 09/036,862, filed on Mar. 9, 1998, now U.S. Pat. No. 5,979,350 for "Water Sport Towing apparatus and Method," reissued as U.S. RE37,823 having Ser. No. 09/613,154 which itself is a continuation-in-part of application Serial No. 29/078,494, filed on Oct. 27, 1997, now U.S. Patent No. Des 409,972 for "Boat Tower," all of which are commonly owned and assigned with the present invention.

FIELD OF INVENTION

The present invention generally relates to towing of a performer by a vessel, and more particularly to enhancing performance of the performer using a water sport implement while maintaining stability of the vessel.

BACKGROUND OF THE INVENTION

Wakeboarding has become one of the fastest growing sports in the world. In the sport of wakeboarding, there is an ever increasing need for the tow boat to create a larger wake to ride. Unlike waterskiing, the performer on a wakeboard is looking for as large a wake as possible. Further, by anchoring the tow line at a high elevation above the boat deck, the greater the ability of the performer to lift higher into the air, whether with a ski or wakeboard.

Tow rope pylons are known in the art, such as those described in U.S. Pat. No. 4,893,577 to Jennings and U.S. Pat. No. 4,641,597 to Paxton. A typical skiing and wakeboarding pylon has a height of approximately three feet to eight above the floor of the boat. Pylon heights have increased to accommodate the ever increasing height of jumps across the wake by wakeboarders. The extended pylons run a cable from the top of the pylon to the bow of the boat as a guy wire. This wire interferes with movement inside the boat. Further, these extended height pylons have not satisfied wakeboarders with their performance. They do give the performer the ability to get bigger air on the jumps, but the extended pylons flex too much when the performer cuts away or to the wake. During these cuts, the boat heels to a point of instability for the boat and a hazard for all concerned. The guy wire provides support when the skier is pulling straight back, but offers less support when the skier is pulling from the side.

The simplest way to increase the size of the wake is to increase the amount of weight inside a boat. Typically, this has been done by adding lots of people. Alternatively, the industry's response has been to include water bladders in the boat or other weighting materials such as buckets filled with concrete, rocks, or sand.

In one bladder system, a liner is placed inside of a canvas sack or bag. Filling the liner full of water by use of a bilge pump with hoses, wires and clips, can add weight to the back of a boat. However, this process is awkward and cumbersome. Another attempt at adding weight to the back of a boat is believed to include two gates on a transom of a boat. A cable is pulled to open the two gates and thereby flood two tanks located behind the transom of the boat. The tanks are drained by opening the gates. This system required a four foot high boat hull, where typical sports towing boats have a transom or hull height of only thirty inches from bottom to top of the gunwale.

As described, by way of example with reference to U.S. Pat. No. 5,645,003 to Grinde, it is known to add water for ballasting, typically uniformly along the length of the boat or forward, as in U.S. Pat. No. 4,528,927 to Lizuka et al. for enhancing the planing of the vessel. Typically ballast pumps are used to control the amount of water within the ballasting, as described, by way of example, with reference to U.S. Pat. No. 5,215,025 to Talmor.

It is typically thought that by simply adding more weight to the boat, the wake will become bigger and better. However, the shape of the wake is as important as the size. The perfect slope, length and hardness of the lip of a wake are also important to enable the performer to release from the wake and achieve a desired launch into the air. Further, it is important that wake control be done in a relatively rapid and timely manner, not available with use of a typical ballast pump. During periods of non-performance by a performer, there is a need to improve travel between performance locations, whether over water or by trailer, without having to disassemble and then reassemble pylons and pylon rigging.

SUMMARY OF THE INVENTION

In view of the foregoing background, it is therefore an object of the present invention to improve the aerial characteristics of a performance by a performer using a water sport implement, such as a wakeboard or ski, by way of example, and being towed by a vessel while maintaining the stability of the vessel.

This and other objects, features, and advantages of the invention, are provided by a method aspect of the invention comprising the steps of providing a vessel behind which the performer is to be towed, the vessel including a bow, a stern and an operator station between opposing sides, and fitting a first relatively rigid vertical support structure to a first one of the sides and fitting a second relatively rigid vertical support structure to a second one of the sides, and then extending a generally horizontal bridging portion between upper extremities of the first and second vertically extending support structures, at a height substantially above the level of the operator station. A tow rope is attached to the horizontally extending bridging portion, and the vessel is operated in a body of water while towing the performer from the horizontally extending bridging portion.

An apparatus of the present invention comprises a vessel behind which the performer is to be towed, the vessel including a bow, a stern and an operator station between opposing sides, a first relatively rigid vertical support structure fitted to a first one of the sides of the vessel, a second relatively rigid vertical support fitted structure to a second one of the sides of the vessel, and a generally horizontal bridging portion extending between upper extremities of the first and second vertically extending support structures, at a height substantially above the level of the operator station. A tow rope is attached to the horizontally extending bridging portion for towing the performer from the horizontally extending bridging portion while operating the vessel in a body of water.

In an alternate embodiment, the apparatus further comprises pivotally attaching means for attaching the first and second generally vertically extending support structures to the respective sides of the vessel, so as to permit the first and second support structures to be rotated downwardly so that the vessel may pass underneath a bridge or into a boat house. Improvements to the rotatable feature of the present invention are provided by yet another preferred embodiment, wherein a towing apparatus comprises a vertical support rigidly dimensioned for rigidly attaching to a vessel at a location proximate an operator station of the vessel, a frame for extending upwardly from the vertical support to a height substantially above the level of the operator station, and attaching means for attaching the frame to the vertical support, the attaching means rigidly attaching the frame to the vertical support in an operating position for towing the performer, while permitting the frame to be rotated about the vertical support into a stored position on a deck of the vessel for reducing a height clearance of the vessel.

In one preferred embodiment, the coupling means comprise a ball and socket assembly carried by a first proximal end of the frame. The ball and socket assembly include a ball carried by the frame, a socket carried by the vertical support, and a shaft extending through the socket. The shaft has a distal end for engaging the ball and a proximal end for manipulating the shaft into and out of engagement with the ball for readily removable attachment of the ball with the socket and thus the frame with the vertical supports. A knob is attached to the proximal end of the shaft, and a compression spring carried by the shaft and positioned between the knob and the socket for biasing the proximal end away from the socket. A pivotal linkage assembly operable between the frame and vertical support is positioned for rotating the frame about the vertical support when the shaft is disengaged from the ball.

BRIEF DESCRIPTION OF DRAWINGS

A preferred embodiment of the invention as well as alternate embodiments are described by way of example with reference to the accompanying drawings in which.

DETAILED DESCRIPTION OF PREFERRED EMBODIMENTS

The present invention will now be described more fully hereinafter with reference to the accompanying drawings, in which preferred embodiments of the invention are shown. This invention may, however, be embodied in many different forms and should not be construed as limited by the embodiments set forth herein. Rather, these embodiments are provided so that this disclosure will be thorough and complete, and will fully convey the scope of the invention to those skilled in the art. Like numbers refer to like elements throughout.

Figure 1:
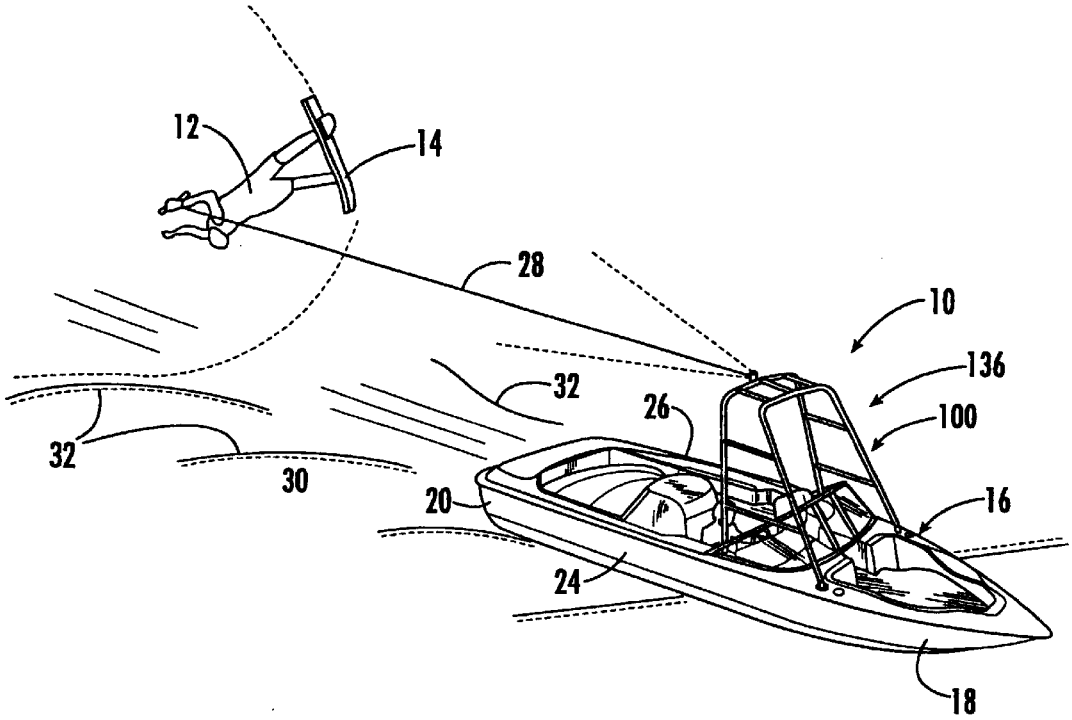
FIG. 1 is a perspective view of a vessel and performer in accordance with the present invention.
Figure 2:
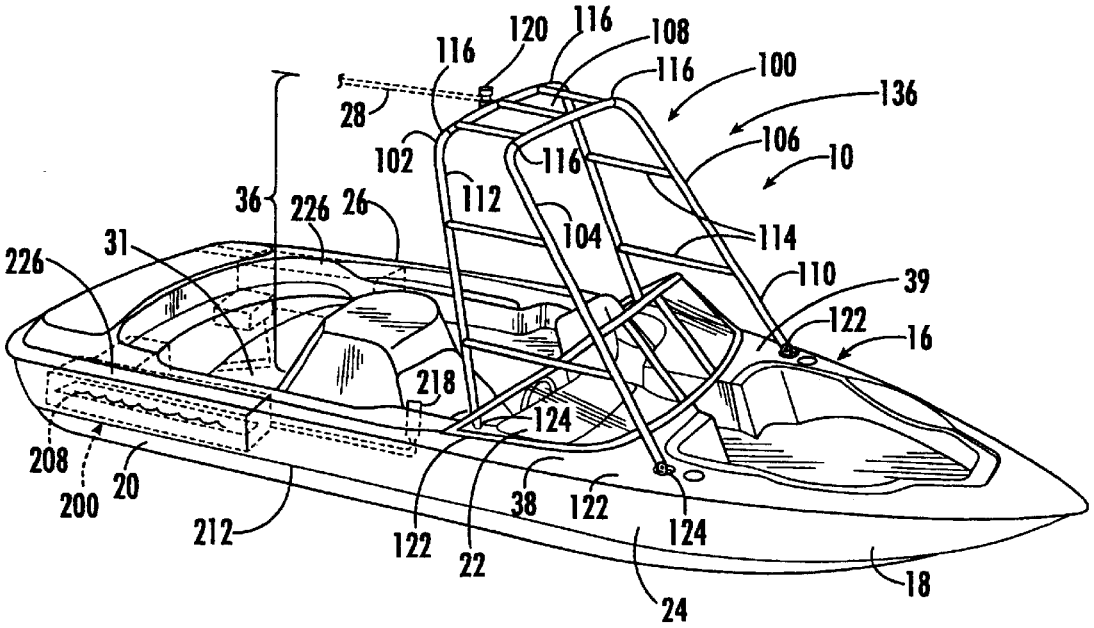
FIG. 2 is an enlarged perspective view of the vessel of FIG. 1 with rear ballast tanks illustrated.
Figure 3:
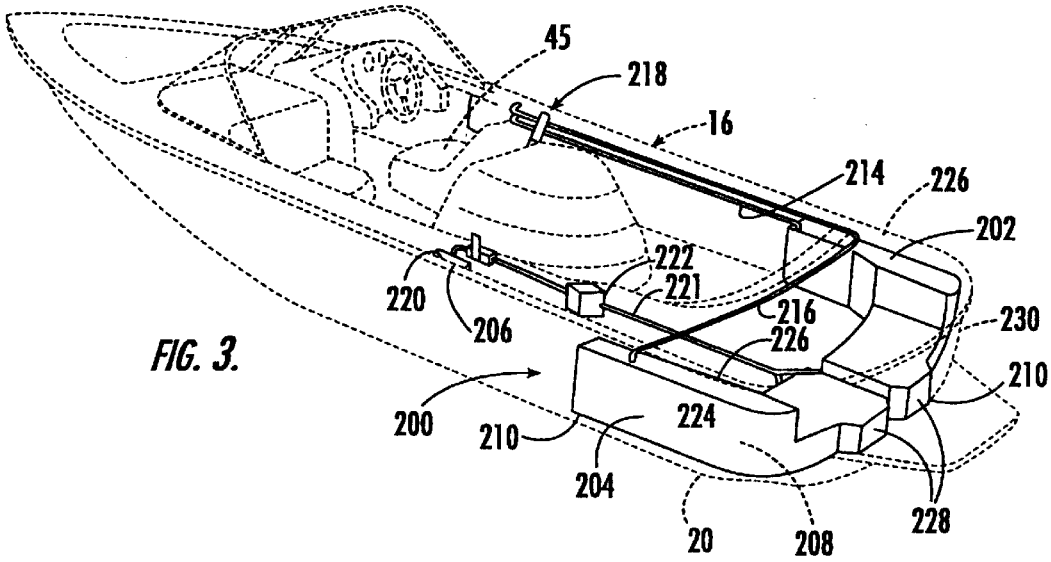
FIG. 3 is a partial perspective view of the ballast tanks carried within the vessel.

Referring now initially to FIGS. 1–3, a preferred embodiment of the present invention is herein described, by way of example, by a water sports system 10 for improving aerial characteristics of a performance by a performer 12 using a water sports implement such as a wakeboard 14. The system 10 comprises a vessel 16 behind which the performer 12 is to be towed. The vessel 16 includes a bow 18, a stern 20, and an operator station 22 positioned generally amidships between opposing starboard and port sides 24, 26. A towing structure referred herein as a vertical support unit 100 is fitted to the vessel 16 generally amidships between the bow 18 and the stern 20. The vertical support unit 100, as will be further described later in this section, includes an upper portion 102 at a height above the level of the operator station 22 and is adapted for securing a tow rope 28 thereto. The tow rope 28 is attached to the upper portion 102 of the vertical support unit 100 for towing the performer 12, as illustrated again with reference to FIG. 1. The system 10 further includes a ballast assembly 200 which includes starboard and port ballast tanks 202, 204 fitted onboard and only aft, preferably within only the stern 20, extending from the transom toward amidships of the vessel 16, unlike typical ballast systems which fully extend bow to stern. Alternate embodiments include a single ballast tank. An extractor 206 is fitted to the hull of the vessel 16 and is in fluid communication with the body of water 30 within which the vessel operates for forcing water 208 into the ballast tanks 204, 202 and weighting down the aft portion of the vessel 16, thus lowering the vessel and controlling a wake 32 created by the vessel.

It is to be noted that various sized vessels will have varying length ballast tanks for extending the tank from the transom area to toward amidships to provide a desirable wake. Simply weighting down the vessel stern only proximate the transom leads to excess plowing of the vessel and an undesirable wake. Further, displacement boats having ballast from stern to bow, typically do not permit planing, desirable in a sports towing vessel. As a result, a certain amount of planing is to be maintained. By extending the ballast tank as herein described, an effective vessel performance and wake is achieved. Without deviating from the invention, alternate embodiments are now herein described.

With regard to the vertical support unit 100, reference being made again to FIG. 2, the vertical support unit comprises a first relatively rigid vertical support structure 104 fitted to the starboard side 24 of the vessel 16, a second relatively rigid vertical support structure 106 fitted to the port side 26, and a generally horizontal bridging portion 108 extending between upper extremities of the first and second vertically extending support structures at a desired height above the level of the operator station 22. In a preferred embodiment, the vertical support unit 100 forms a skeletal frame, as illustrated again with reference to FIG. 2, which has a forward relatively rigid U-shaped support structure 110 and an aft relatively rigid U-shaped support structure 112, both fitted across the beam of the vessel 16. Longitudinally extending rigid bars 114 are attached between the forward and aft U-shaped structures. In a preferred embodiment, the bars are generally horizontal and parallel to the floor 34 of the vessel 16, as illustrated with reference again to FIG. 2, by way of example. Such a frame transfers forces generated by towing the performer to the gunwales, by way of example, and provides a rigid anchoring of the tow rope to the vessel for improving over typical single tow bar devices referred to earlier in this specification. For convenience in shipping, the bridging portion 108 is separable from the vertical support structures 104, 106 at connections 116. In general, the preferred embodiment is made from generally rigid aluminum tubing with elements of the unit 100 welded to each other to form a generally rigid skeletal frame.

Figure 4:
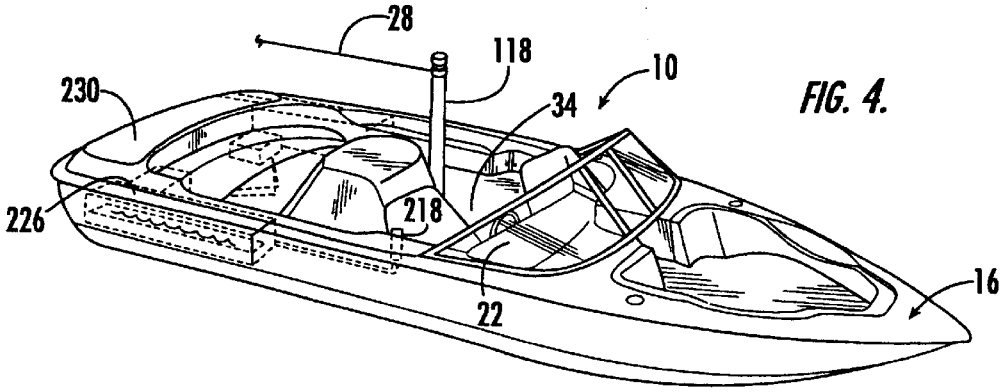
FIG. 4 is a perspective view of an alternate embodiment.
Figure 5:
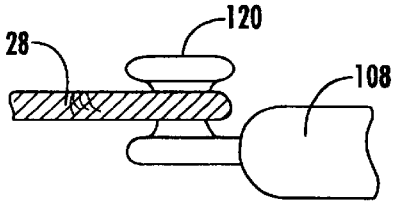
FIG. 5 is a partial side view of a towing element of the present invention.

In yet another embodiment, and with reference to FIG. 4, the vertical support unit 100 comprises a pylon 118 extending from the floor 34 of the vessel 16 and having an upper portion adapted for securing the tow rope 28 thereto. As illustrated again with reference to FIG. 2, and illustrated further with reference to FIG. 5, a tow rope connecting element 120 is attached to the upper portion of the vertical support unit 100, preferably to the horizontal bridging port 108 of the aft U-shaped support structure 112 for attaching the tow rope 28 thereto. The tow rope connecting element is mounted at a height 36 between 6'3" and 7 feet above the floor 34 of the vessel 16, but it is expected that other heights will be selected by those skilled in the water sports arts. At this height 36, passengers on the vessel can comfortably walk under the U-shaped support structure 112 and the tow line 28 extending rearwardly from the boat for pulling the performer 12 while, at the same time, maintaining stability for the vessel 16 as the performer maneuvers around the vessel during the performance.

Figure 6:
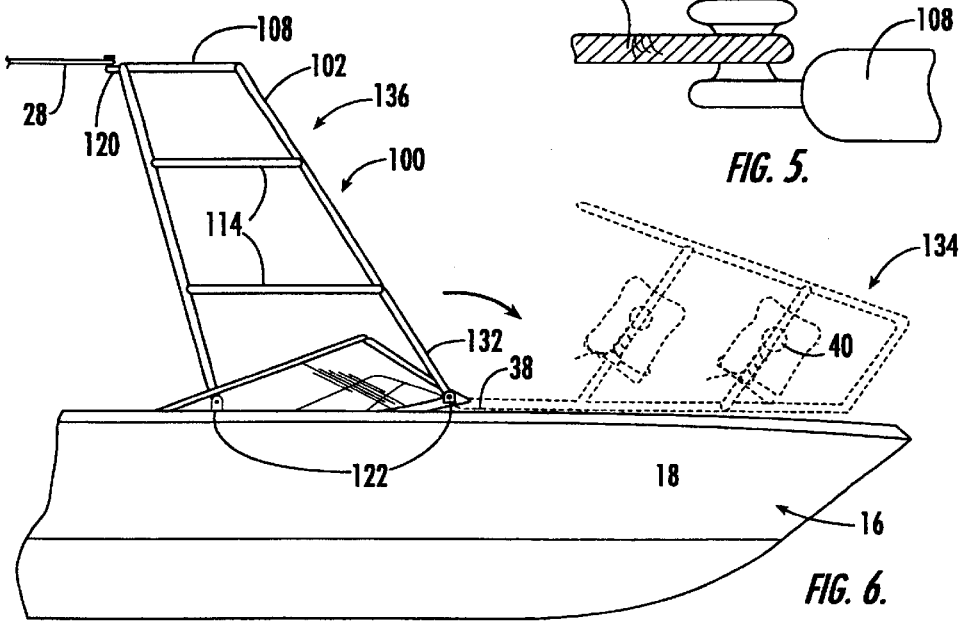
FIG. 6 is a partial side view of the embodiment of FIG. 2 illustrating an operating erected position and a rotated storing position of a towing structure of the present invention.
Figure 7:
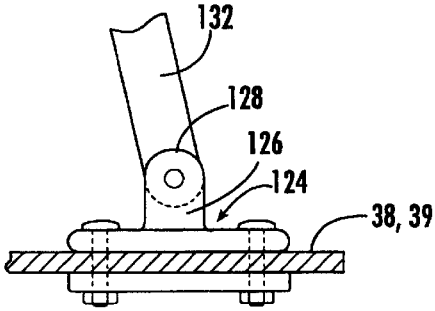
FIG. 7 is a partial side view of an attachment portion of the towing structure of FIG. 6.
Figure 8:
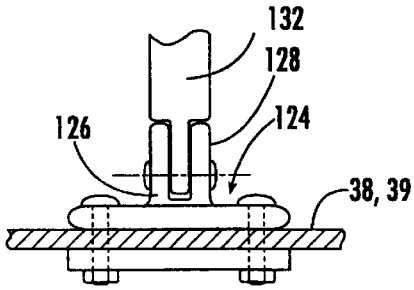
FIG. 8 is a partial front view of FIG. 7.
Figure 11:
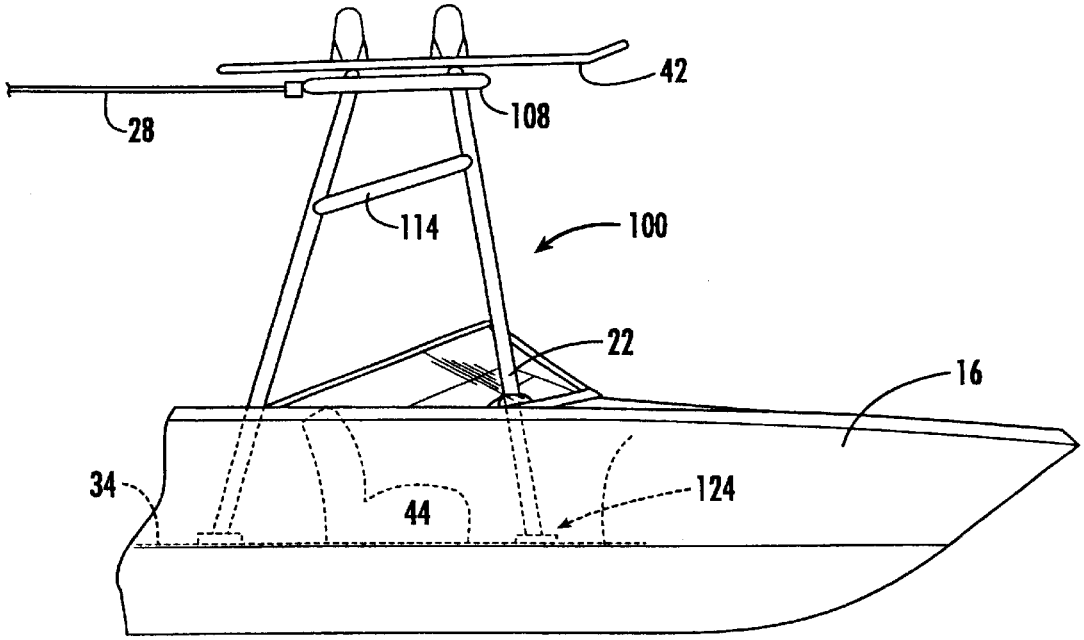
FIG. 11 is a partial side view of an alternate embodiment of FIG. 2.
Figure 12:
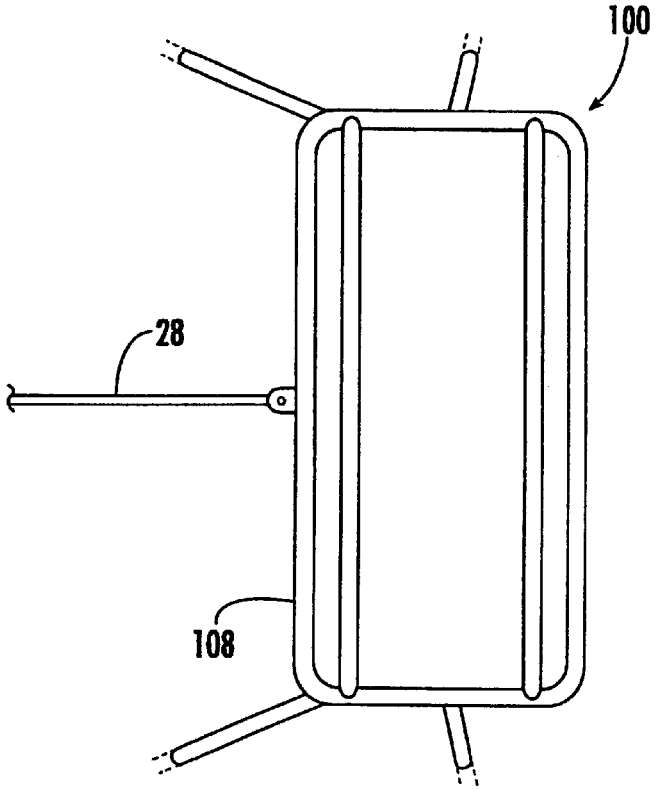
FIG. 12 is a partial top plan view of the embodiment of FIG. 11.
Figure 13:
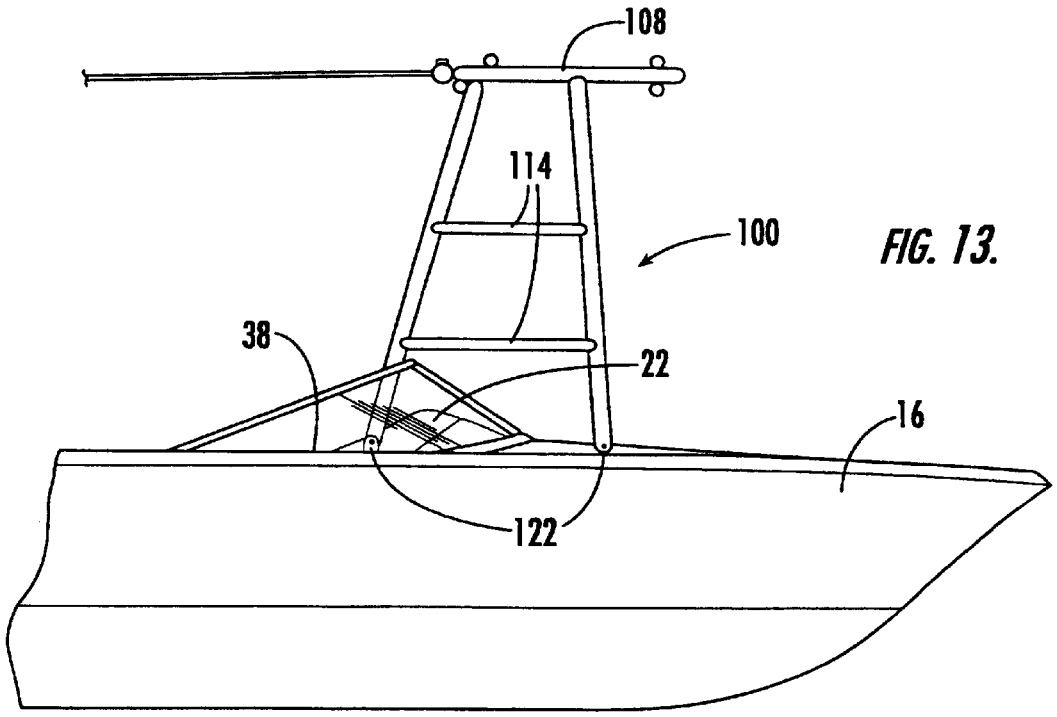
FIG. 13 is a partial side view of yet another embodiment of FIG. 2.

The skeletal frame is an improvement over the pylon by providing a generally more rigid unit 100 secured to four mounting locations 122 at sides 24, 26 of the vessel 16. In a preferred embodiment of the invention, the vertical support unit 100, as illustrated with reference again to FIG. 2, and to FIGS. 6–8, the system 10 further comprises attaching the vertical support unit 100 to vessel deck portions including starboard and port side gunwales 38, 39, so as to permit the unit to be rotated when the vessel needs to pass underneath a bridge or into a boat house, by way of example. In a preferred embodiment, anchoring plates 124 are located about the operator station 22. The anchoring plates 124 each include a shaft 126 which terminates in a free end 128 having a through hole for receipt of a pivot pin or bolt 130. Removably and rotatably mounted on the anchoring shafts 126 are lower extremities 132 of the skeletal frame, as illustrated with reference again to FIGS. 7 and 8. As illustrated with reference to FIG. 11, an alternate arrangement includes mounting the plates 124 to the floor 34 of the vessel 16.

Towing a trailer carrying the vessel is made more convenient with this rotating feature. In the event the overall height of the unit 100 needs to be reduced during hauling of the vessel on a trailer, by way of example, the unit 100 is rotatable to a position 134 shown in dotted lines in FIG. 6 or is removable entirely from the vessel 16. As illustrated again with reference to FIGS. 7 and 8, the pin or bolt 130 is removed from the appropriate anchoring plates 124 for rotating the unit 100 onto the forward deck of the vessel or aft at the convenience of the operator.

Figure 14:
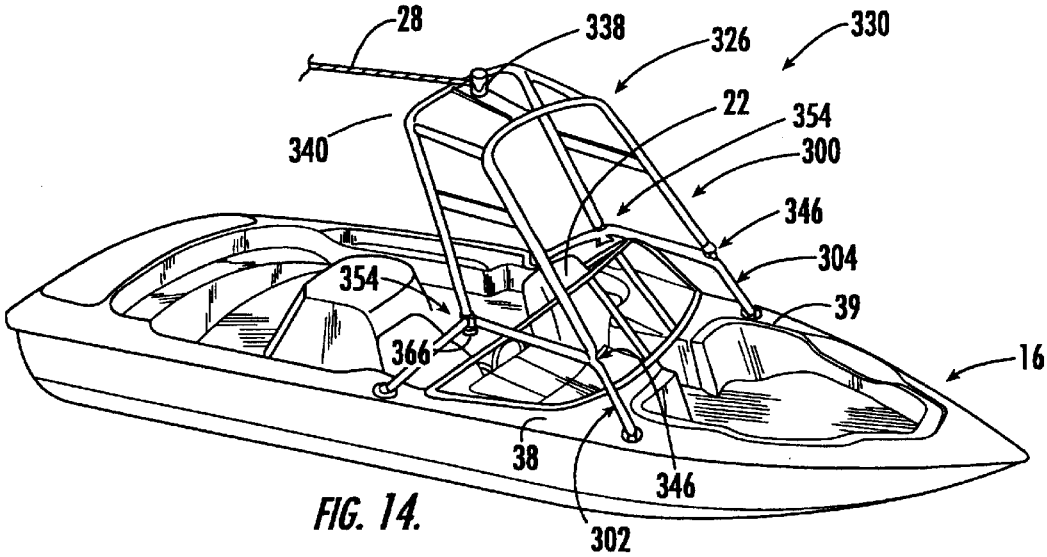
FIG. 14 is a perspective view of the vessel including an alternate preferred embodiment of a towing apparatus in keeping with the present invention.
Figure 15:
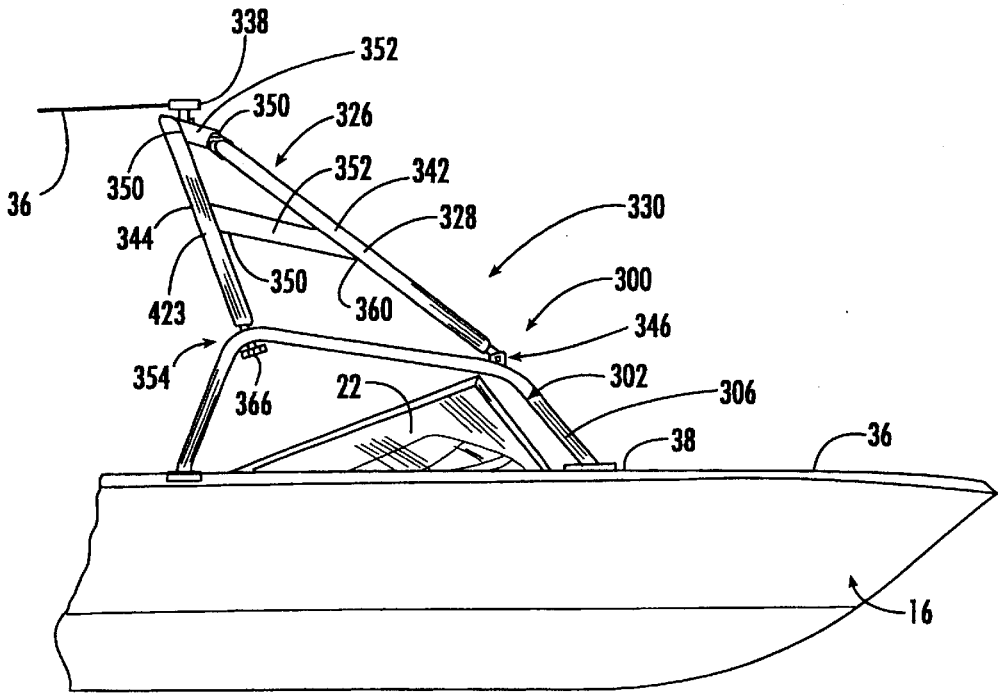
FIG. 15 is a partial starboard side elevation view of the vessel and towing apparatus of FIG. 14 illustrating the towing apparatus in an operating position for towing a performer.
Figure 16:
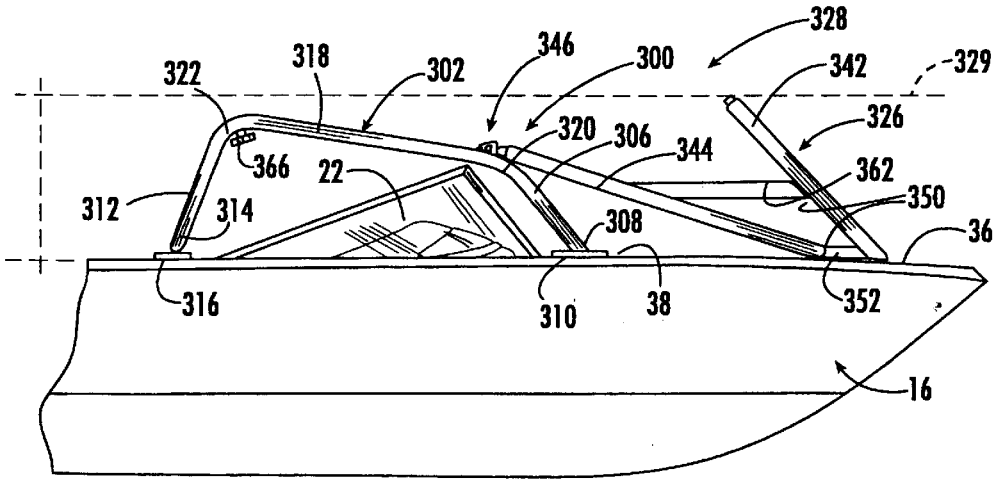
FIG. 16 is a view of the vessel and towing apparatus of FIG. 15 illustrating the towing apparatus in a stored position.

Improvements to a preferred embodiment of the present invention are made to enhance the portability and storing of the vertical support unit 100, earlier described, and hereon initially illustrated with reference to FIGS. 14–16, wherein one preferred embodiment of a towing apparatus 300 comprises starboard and port elongate vertical supports 302, 304 rigidly attached to the starboard side and port side gunwales 38, 39, respectively, of the vessel 16 at a location generally outboard the operator station 22. Each of the vertical supports includes an upwardly extending forward portion 306 having a proximal end 308 rigidly mounted via a mounting plate 310 to the gunwale 38, 39, an upwardly extending aft portion 312 having a proximal end 314 rigidly mounted to the gunwale 38, 39 via a mounting plate 316, and a middle portion 318 extending between distal ends 320, 322 of the forward and aft portions. As further illustrated with reference again to FIGS. 15 and 16, the distal end 322 of the aft portion 312 extends to a higher elevation above the surface of the gunwale 38, 39 than does the distal end 320 of the forward portion 306. This permits an aft portion 423 of a frame 326 to be shorter in length than a forward portion 328 of the frame, allowing for a lower elevation of the frame when in a stored position 328, as illustrated with reference to the elevation line 329 of FIG. 16.

In an operating position 330, the frame 326 extends upwardly from and between the starboard and port elongate vertical supports 302, 304 to the height 36 substantially above the level of the operator station 22, as earlier described with reference to FIG. 2. An aft proximal end 332, 333 of the frame 326 is readily removable attached to each of the elongate vertical supports 302, 304, and a forward proximal end 334, 335 of the frame is pivotally attached thereto for rigidly securing the frame in the operating position 330, see FIG. 15, when the aft proximal end is attached, while permitting the frame to be rotated about the forward proximal end to the stored position 328, see FIG. 16, on the deck 336 of the vessel 16 when the aft proximal end of the frame is detached and rotated.

As illustrated with reference again to FIGS. 15 and 16, by way of example, a tow rope connecting element 338 is attached to a distal end 340 of the frame 326 for attaching the tow rope 28 thereto used in towing a performer from the frame while operating the vessel in a body of water. The distal end 340 is upwardly angled, allowing the distal end to lie generally flat onto the deck 36, with the toe rope connecting element 338 conveniently received within the open styled deck for the vessel herein described, by way of example. As earlier described, and as illustrated in the operating position 330 of FIG. 15, by way of example, with forward and aft U-shaped supports 342, 344, rearwardly angled and vertically extended, the aft support 344 is shorter in length than the forward support 342, allowing for the reduced elevation line 329 earlier described with reference again to FIG. 16.

Figure 17:
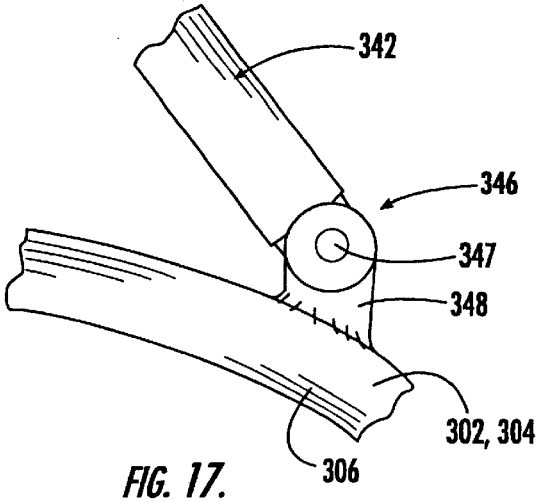
FIGS. 17 and 18 are partial side and front elevation views of a pivotal portion of the towing apparatus of FIG. 14.
Figure 18:
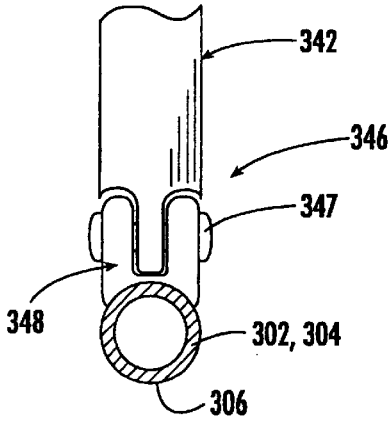

By way of further detail, and as illustrated with reference to FIGS. 17–18, the forward U-shaped support 342 is pivotally attached at each of its ends to the starboard and port vertical supports 302, 304, at the forward distal ends of the upwardly extending forward portions 306. A pivotal linkage assembly 346 includes a pivot pin 347 operable with a mating fork assembly 348. As illustrated with reference to FIGS. 19–21, the aft U-shaped support 344 is readily removably attached to the distal ends 322 of the upwardly extending aft portion 312 of the vertical supports 302, 304. The forward U-shaped support 342 is rigidly attached to the aft U-shaped support 344 at multiple weld points 350 and with the use of attaching arms 352.

Figure 9:
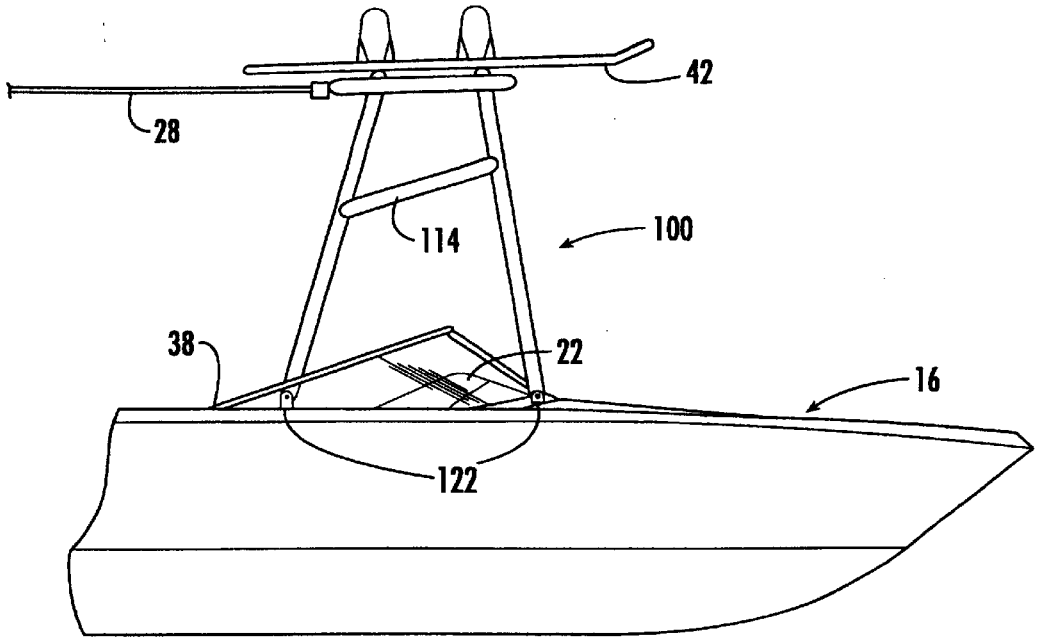
FIG. 9 is a partial side view of an alternate embodiment of FIG. 2.
Figure 19:
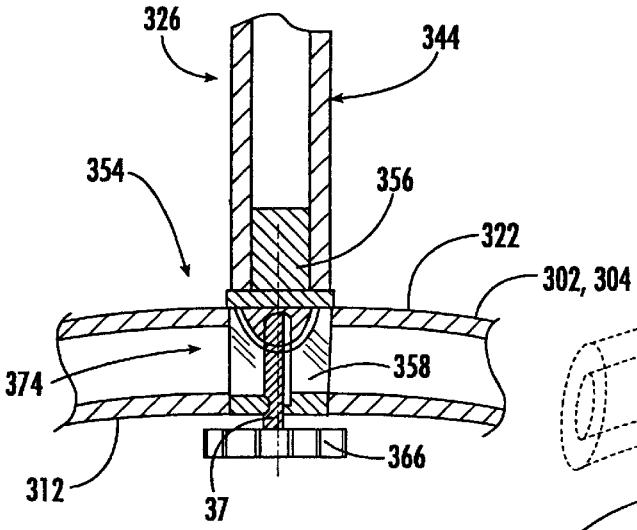
FIGS. 19 and 20 are partial cross-section views of a coupling assembly of the towing apparatus of FIG. 14, illustrating an attached position and a detached position, respectively, between a frame and a support.
Figure 21:
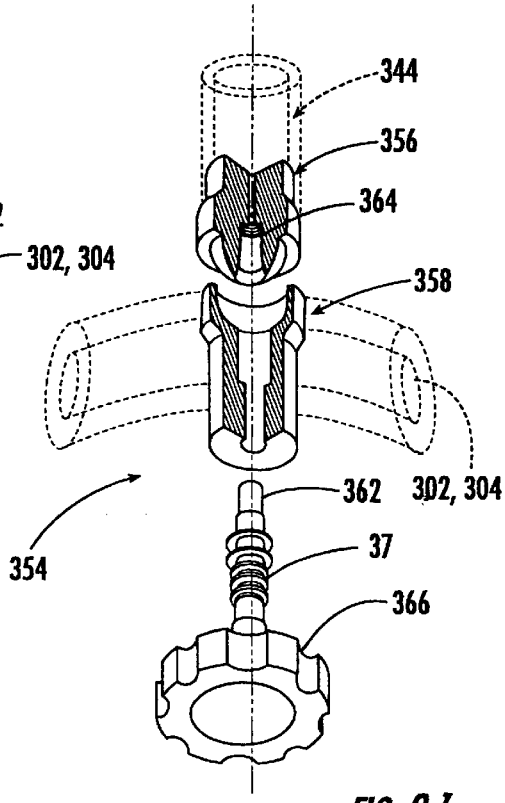
FIG. 21 is an exploded, partial cross section view of a ball and socket assembly of FIGS. 19 and 20.
Figure 20:
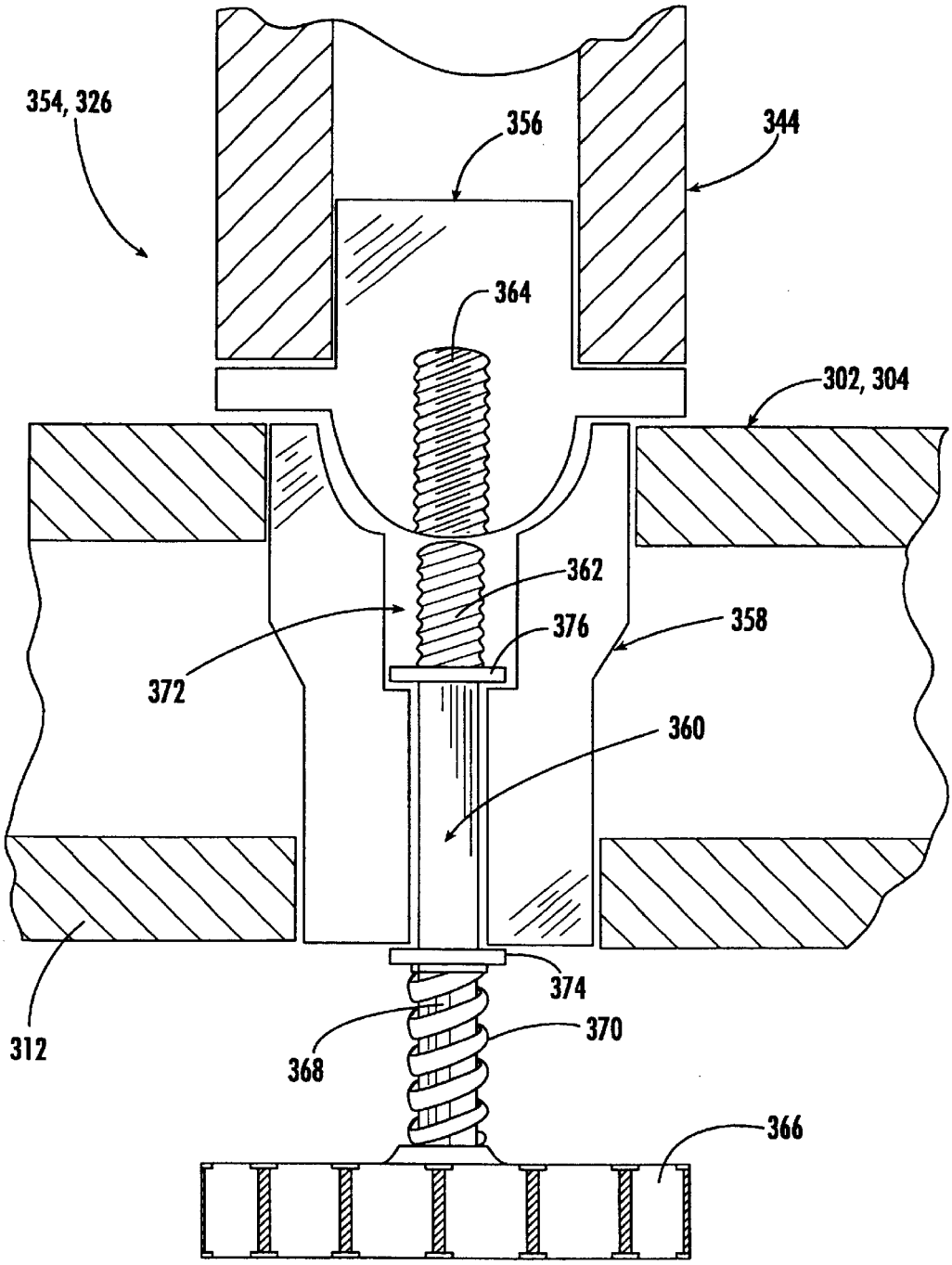

In a preferred embodiment, herein described by way of example, a coupling assembly 354 is operable between the frame 326 and the vertical supports 302, 304, and is described in detail with reference to FIGS. 19–21. The coupling assembly 354 comprises a ball element 356 attached to the proximal ends of the aft U-shaped support 344 and a socket element 358 carried by the distal ends of the upward extending aft portions 312 of the starboard and port vertical supports 302, 304. A shaft 360 extends through the socket element 358 and has a threaded distal end 362 for engaging a threaded bore 364 within the ball element 356. A knob 366 is attached to the proximal end 368 of the shaft 360 for manipulating the shaft into and out of engagement with the ball element 356 and for readily removing the ball element from engagement with the socket element 358, and thus the frame 326 from the aft portion of the vertical supports 302, 304. A compression spring 370 is carried by the shaft 360 and is positioned between the knob 366 and the socket element 358 for biasing the knob away from the socket element and thus avoid excessive movement of the shaft and knob when in a disengaged position 372, as illustrated again with reference to FIG. 20, illustrating the compression spring in an extended position. To rigidly secure the aft portion of the frame 326 to the aft portions of the supports 302, 304, the ball element 356 is guided into the socket element 358 in an indexing manner, and the threaded end 362 of the shaft 360 is manually engaged by pushing and turning the knob 366 to place the coupling assembly 354 into a secured position 374, as illustrated with reference again to FIG. 19, illustrating the compression spring in a compressed position. The pivotal linkage assembly 346 pivotally connecting the forward portion of the frame 326 to the forward portion of the vertical supports 302, 304 is positioned for rotating the frame about the vertical supports when the shaft 360 is disengaged from the ball element 357. A washer 374 is inserted between the socket element 358 and the compression spring 370. A snap ring 376 secures the shaft 360 within the socket element 358 and limits axial movement as further illustrated with reference to FIG. 20. With such structures as herein described, it is convenient to use portions of the unit 100 to stow (i.e., store or attach) various pieces of ancillary equipment such as a life vest 40 or wakeboard 42 and other equipment, as illustrated by way of example, with reference again to FIG. 6 and FIG. 9. Further, the convenient mounting of stereo speakers is also accomplished. Such equipment is also conveniently stowed out of the way when unit 100 is in the erect position 136 as earlier described with reference to FIGS. 1 and 2.

Figure 10:
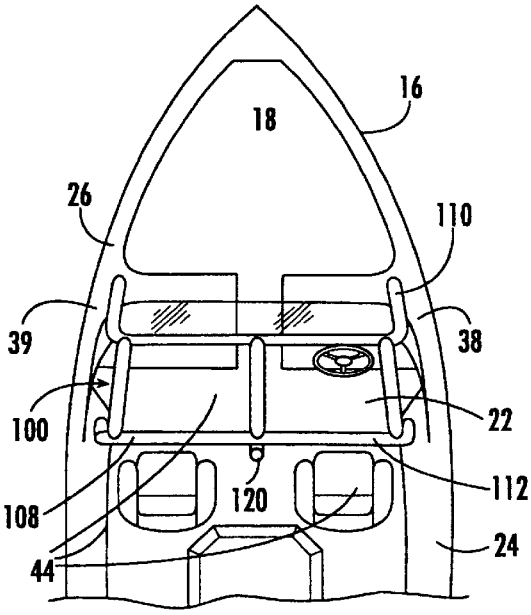
FIG. 10 is a partial top plan view of the embodiment of FIG. 2.

As illustrated with reference to FIG. 10, a clear line of sight is provided for individuals sitting in the seats 44 so as not to interfere with the steering of the vessel 16 or the maneuvering of passengers onboard. As illustrated, by way of example with reference to FIGS. 2, and 9–14, various embodiments of the present invention are possible without deviating from the intent and value thereof.

Figure 22:
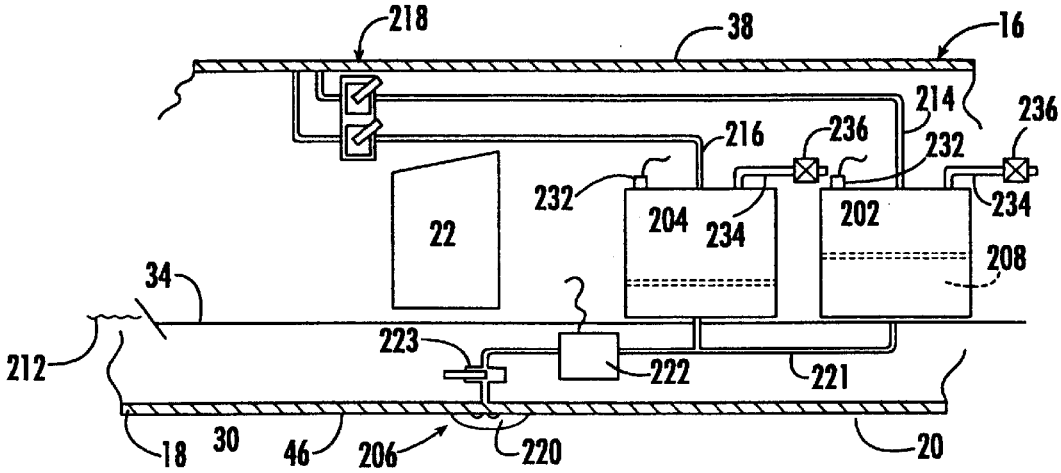
FIG. 22 is a schematic of a ballast tank control system of the present invention.

As illustrated with reference again to FIGS. 2–3, and to FIG. 22, a preferred embodiment of the system 10 and the ballast assembly 200, a lower most portion 210 of each of the ballast tanks 202, 204 is preferably fitted at the waterline 212 of the vessel 16 when the tanks are empty, typically the floor 34 for towing vessels as herein described.

In preferred embodiments of the ballast tanks 202, 204 and with reference again to FIGS. 3 and 22, the ballast tanks are enclosed and each have an opening arranged through vent lines 214, 216 for venting air into and out of each of the enclosed tanks 202, 204 respectively. Further, an air control valve 218 is within easy reach by the vessel operator for manually controlling air venting to each of the ballast tanks. It is anticipated that electrically, pneumatically or hydraulically operated control valves may be appropriate. The extractor 206, earlier described, includes a water scoop 220 positioned below the water line 212 and on the hull 46 of the vessel 16 for extracting the ballast water 208 from the body of water 30 as the vessel 16 moves through the body of water and delivering the ballast water 208 through a water intake line 221 connected between the scoop 220 and ballast tanks 202, 204. In an alternate embodiment, a two way pump 222 is placed within the line 221 and used for enhancing the extracting and dumping of the ballast water 208. Further, a shut off valve 223 is fitted within the line 221. As illustrated again with reference to FIGS. 2 and 3, the ballast tanks 202, 204 comprise starboard and port enclosed ballast tanks wherein each of the starboard and port enclosed ballast tanks comprises a generally L-shaped tank having a first elongated leg 224 fitted beneath quarter gunwales 26 of the vessel 16 and a second leg 228 fitted along an inboard side of the transom 230.

As illustrated with reference again to FIG. 3, intermediate of the stem 20 and bow 18 is the operator's seat 45 within which the operator sits to control steering while viewing instruments. The air control valve 218 is within easy reach of the operator.

As illustrated again with reference to FIG. 22, the inlet line 221 leads to a water scoop 220 which collects the ballast water 208 as the vessel 16 is moved forward through the body of water 30. The water 208 collected in the scoop 220 is fed through the intake line 221 upon proper positioning of the valves 218, 223. If the shut off valve 223 is closed, no water 208 will be allowed to be fed into ballast tanks 202, 204. In addition, water 208, if already in ballast tanks 202, 204 will not be allowed to leave the tanks. However, if the water 208 is to be introduced into ballast tanks 202, 204, the shut off valve 223 must be opened and in addition, the respective air line control valve 218, independently controlling each of the air lines 214, 216 must be opened to allow air to escape from the ballast tanks as the water is being scooped up and fed into the tanks. Thus, if the air line control valve 218 is open, water 208 will be forced into ballast tanks 202, 204 as the boat is moving forward until the ballast tanks are full or the valves are closed. Excess water is forced through the air lines 214, 216 past the air line control valve 218 as one indication that the tanks are full. Alternatively, water level indicators 232 are used. Additionally, tank overflow tubes 234 fitted with one way check valves 236 deliver excess water overboard, as illustrated again with reference to FIG. 22. The overflow tubes 234 limit the maximum pressure in the tanks to a maximum static head. The check valves 236 stop air from flowing back in the tanks when the air control valve 218 is closed.

To remove the water 208 from the tanks 202, 204, the vessel comes to a stand still in a preferred method of dumping the ballast water. The shutoff valve 223 is then opened, with the opening of the air control valve 218 for allowing air into the air lines 214, 216. Through the forces of gravity, the water 208 flows out of the tanks 202, 204 through the intake line 221 and out through the opened shutoff valve 223 to the surrounding body of water 30.

Since the operator sitting in seat 45 has easy access to both valves 218, 223, the amount and shape of the wake 32, illustrated with reference again to FIG. 1, produced by the vessel 16 can be precisely controlled by the operator. By selectively shifting the ballast water 208 into and out of the tanks 202, 204, the wake 32 is produced to a controlled degree for optimum and desirable wakeboarding.

Accordingly, many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that modifications and embodiments are intended to be included within the scope of the appended claims.

That which is claimed is:

1. A method for towing a wakeboard performer across a body of water, the method comprising the steps of:

providing a towing vessel having a forward bow, and aft stern, opposing starboard and port gunwales and an operator's station between the gunwales;

fitting a skeletal towing frame to the vessel for supporting an elevated tow rope attachment point substantially above the vessel, the skeletal towing frame fitting step including:

(a) attaching a first, generally vertical support to the starboard gunwale;

(b) attaching a second, generally vertical support to the port gunwale;

(c) providing the first and second supports with sufficient length so that the vertical extremities thereof extend substantially above the vessel;

(d) attaching a third support with the vessel forward of the first and second supports, with the third support extending upwardly and aft;

(e) spacing the third support from the first and second supports a sufficient distance to impart stability to the skeletal towing structure;

(f) providing means for coupling the upper portions of the first, second and third supports with a generally horizontal bridging portion;

fitting the tow rope attachment point with the bridging portion extending aft toward the stern and at a location generally positioned vertically above a level of the operator's station in an area of the vessel centrally located between the bow and the stern; and towing the wakeboard performer with the towing vessel by a tow rope attached to the tow rope attachment point.

2. The method recited in claim 1 further comprising the step of attaching each of the first and second supports with the respective starboard and port gunwales of the vessel so that at least a portion of each of the first and second supports is rotatable into a horizontal storage position.

3. The method recited in claim 1, wherein the bridging portion providing step comprises the step of extending at least one generally horizontal member laterally across and spaced above the vessel.

4. The method recited in claim 1 further comprising the step of forming the first, second and third supports as rigid members.

5. The method recited in claim 1 wherein the operator's station is located generally amidships between the bow and the stern, the method further comprising the step of positioning the tow rope attachment point generally amidship and generally vertically above the operator's station.

6. A method for towing a wakeboard performer across a body of water, the method comprising the steps of:

providing a towing vessel having a forward bow, an aft stern, opposing starboard and port gunwales and an operator's station between the gunwales and generally amidships between the bow and the stern;

fitting a skeletal towing frame to the vessel for elevating a tow rope attachment point substantially above the level of the operator's station, the skeletal towing frame fitting step including:

(a) attaching first and second supports at spaced locations along the starboard gunwale;

(b) attaching third and fourth supports at spaced locations along the port gunwale;

(c) extending a portion of each of the first, second, third and fourth supports generally angularly and upwardly from the respective attachment locations to a position located amidship and in an area generally vertically above a central area of the vessel between the bow and the stern;

(d) providing a horizontal bridging portion over the central area between the upper extremities of the first, second third and fourth supports;

fitting the tow rope attachment point with the bridging portion and aft toward the stern; and towing the wakeboard performer with the towing vessel by a tow rope attached to the tow rope attachment point.

7. A method for towing a water sport performer behind a recreational tow boat, the method comprising the steps of:

providing a recreational tow boat having a hull with a bow, a stern, opposing starboard and port gunwales extending along the hull between the bow and the stern and an operator's location positioned between the bow and the stern;

fitting the recreational tow boat with an elevated towing structure including a first support portion fitted to the starboard gunwale at a first location and a second support portion fitted to the port gunwale at a second location;

spacing the first and second locations from the operator's location;

angling the first and second support portions generally upwardly and toward an area generally vertically above the operator's location such that upper extremities of the first and second support portions are mechanically joined together in an area generally vertically above a portion of the vessel centrally located between the bow and the stern;

fitting a third support portion to the tow boat at a third location spaced from the first and second locations:

extending the third support portion upwardly and mechanically joining an upper extremity thereof with the upper extremities of the first and second support portions;

fixing a tow rope attachment point adjacent a location of mechanical joinder of the upper extremities of the first, second and support portions and facing aft toward the stern; and towing the wakeboard performer with the recreational towboat by a tow rope attached to the tow rope attachment point.

8. The method recited in claim 7 further comprising the step of angling the third support upwardly to the upper extremity thereof.

9. A method for towing a wakeboard performer across a body of water, the method comprising the steps of:

providing a towing vessel having a forward bow, and aft stern, opposing starboard and port gunwales and an operator's station between the gunwales wherein the operator's station is located generally amidships between the bow and the stern;

fitting a skeletal towing frame to the vessel for supporting an elevated tow rope attachment point substantially above the vessel, the skeletal towing frame fitting step including:

(g) attaching a first, generally vertical support to the starboard gunwale;

(h) attaching a second, generally vertical support to the port gunwale;

(i) providing the first and second supports with sufficient length so that the vertical extremities thereof extend substantially above the vessel (j) attaching a third support with the vessel forward of the first and second supports, with the third support extending upwardly and aft;

(k) spacing the third support from the first and second supports a sufficient distance to impart stability to the skeletal towing structure;

(l) providing means for coupling the upper portions of the first, second and third supports with a generally horizontal bridging portion; fitting the tow rope attachment point with the bridging portion extending aft toward the stern and at a location generally positioned vertically above a level of the operator's station amidships located between the bow and the stern, and generally vertically above the operator's station; and towing the wakeboard performer with the towing vessel by a tow rope attached to the tow rope attachment point.

10. The method recited in claim 9 further comprising the step of attaching each of the first and second supports with the respective starboard and port gunwales of the vessel so that at least a portion of each of the first and second supports is rotatable into a horizontal storage position.

11. The method recited in claim 9, wherein the bridging portion providing step comprises the step of extending at least one generally horizontal member laterally across and spaced above the vessel.

* * * * *